US010199769B2

(12) United States Patent
Wu et al.

(10) Patent No.: US 10,199,769 B2
(45) Date of Patent: Feb. 5, 2019

(54) PLUG CONNECTOR ASSEMBLY HAVING IMPROVED LOCKING STRUCTURE

(71) Applicant: FOXCONN INTERCONNECT TECHNOLOGY LIMITED, Grand Cayman (KY)

(72) Inventors: Jerry Wu, New Taipei, CA (US); Jun Chen, Kunshan (CN); Xiao Fan, Kunshan (CN); Zhi-Yong Zhou, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/817,319

(22) Filed: Nov. 20, 2017

(65) Prior Publication Data

US 2018/0145450 A1 May 24, 2018

(30) Foreign Application Priority Data

Nov. 23, 2016 (CN) ..... 2016 1 1040949

(51) Int. Cl.
*H01R 13/627* (2006.01)
*H01R 13/506* (2006.01)
(Continued)

(52) U.S. Cl.
CPC ..... *H01R 13/6273* (2013.01); *H01R 13/506* (2013.01); *H01R 13/6275* (2013.01);
(Continued)

(58) Field of Classification Search
CPC ..... H01R 13/506; H01R 13/4223; H01R 13/4226; H01R 13/4362; H01R 13/6285;
(Continued)

(56) References Cited

U.S. PATENT DOCUMENTS 6,607,397 B1 * 8/2003 Zhang ..... H01R 13/193 439/357
6,786,755 B2 * 9/2004 Dambach ..... H01R 13/6273 439/353

(Continued)

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

A plug connector assembly includes: a mating member including an insulative housing and a pair of latching members retained in the insulative housing; a cable; and an outer case, wherein the latching member includes a base portion, a fixing portion forwardly extending from the base portion, a connecting portion upwardly extending from the base portion, an elastic portion forwardly and rearwardly extending from an extremely end of the connecting portion, a locking portion disposed on a front side of the elastic portion and exposed to the insulative housing, and a pressing portion downwardly extending from a rear end of the elastic portion beyond the base portion; the outer case defines an operating portion for operating the latching member; the operating portion drives the pressing portion to disengage the latching with a mating connector; andthe operating direction of the operating portion is opposite to the movement direction of the locking portion.

20 Claims, 8 Drawing Sheets

(51) Int. Cl.
*H01R 13/635* (2006.01)
*H01R 24/28* (2011.01)
*H01R 24/60* (2011.01)

(52) U.S. Cl.
CPC ..... *H01R 13/635* (2013.01); *H01R 24/28* (2013.01); *H01R 24/60* (2013.01)

(58) Field of Classification Search
CPC ..... H01R 13/629; H01R 13/6293; H01R 13/6257; H01R 11/6275; H01R 11/6282
USPC ..... 439/155, 296, 595, 607.2
See application file for complete search history.

(56) References Cited

U.S. PATENT DOCUMENTS 6,976,876 B1 * 12/2005 Su ..... H01R 13/6583 439/357
7,114,963 B2 10/2006 Shuey et al.
7,198,522 B1 * 4/2007 Ho ..... H01R 9/032 439/660
7,210,965 B1 * 5/2007 Zhong ..... H01R 13/502 439/607.01
7,351,103 B1 * 4/2008 Peng ..... H01R 13/6275 439/595
7,442,066 B1 * 10/2008 Ho ..... H01R 13/6275 439/352
7,445,486 B2 * 11/2008 Shen ..... H01R 13/6273 439/353
7,651,375 B2 * 1/2010 Zhu ..... H01R 13/6658 439/607.41
7,922,536 B2 * 4/2011 Zhang ..... H01R 13/6583 439/607.45
8,142,224 B2 * 3/2012 Wu ..... H01R 13/648 439/353
8,231,400 B2 * 7/2012 Phillips ..... G02B 6/4201 439/357
8,523,605 B2 * 9/2013 Kobayashi ..... H01R 31/08 439/510
8,556,648 B2 * 10/2013 Wu ..... H01R 13/5213 439/276
8,794,992 B2 * 8/2014 Hsu ..... H01R 13/5213 439/353
9,028,268 B2 * 5/2015 Hsu ..... H01R 13/5213 439/353
9,287,668 B2 * 3/2016 Chen ..... H01R 24/62
9,397,442 B2 * 7/2016 Sutter ..... H01R 24/62
2005/0282424 A1 * 12/2005 Huang ..... H01R 13/6275 439/353
2006/0148300 A1 * 7/2006 Huang ..... H01R 13/6275 439/353
2008/0176441 A1 * 7/2008 Shen ..... H01R 13/6273 439/352
2009/0156059 A1 * 6/2009 Zhu ..... H01R 13/6658 439/607.41
2011/0034061 A1 * 2/2011 Wu ..... H01R 13/648 439/345
2015/0255911 A1 * 9/2015 Kato ..... H01R 13/6275 439/345
2015/0288104 A1 * 10/2015 Regnier ..... H01R 24/62 439/676
2015/0333460 A1 * 11/2015 Regnier ..... H01R 24/62 439/676
2015/0364865 A1 * 12/2015 Sutter ..... H01R 24/62 439/345
2016/0141803 A1 * 5/2016 Hsu ..... H01R 24/60 439/607.55
2016/0315418 A1 * 10/2016 Sutter ..... H01R 24/62

* cited by examiner

PLUG CONNECTOR ASSEMBLY HAVING IMPROVED LOCKING STRUCTURE

BACKGROUND OF THE INVENTION

1. Field of the Invention

The present invention relates generally to a plug connector assembly and more particularly to an improved locking structure for locking with a mating connector.

2. Description of Related Arts

U.S. Patent Application Publication No.2015/0288104, published on Oct. 8, 2015, shows a plug connector assembly including a mating member, a cable electrically connected with the mating member, and an outer case enclosing the mating member and the cable. The mating member includes an insulative housing and a locking member assembled on the insulative housing. The locking member includes a flat base portion, a pair of connecting portions extended from the central portions of both sides of the base portion, a pair of elastic portions upwardly extending from upper ends of the connecting portions, and a pair of fixing portions forwardly and rearwardly extending from the sides of the base portion. Each of the elastic portions defines a locking portion on an end thereof and a pressing portion at a central position thereof. The outer case defines a handle portion arranged with the pressing portion to disengage the locking portions from a mating connector.

Since the locking portion and the handle portion are disposed on a same side, the movement space of the handle portion is too small to disengage the locking portions from the mating connector easily.

An improved locking structure in a plug connector assembly is desired.

SUMMARY OF THE INVENTION

An object of the present invention is to provide an improved locking structure easy for operating to disengage from a mating connector.

To achieve the above-mentioned object, a plug connector assembly comprises: a mating member including an insulative housing and a pair of latching members retained in the insulative housing; a cable electrically connected to the mating member; and an outer case enclosing the mating member and the cable; wherein the latching member includes a base portion, a fixing portion forwardly extending from the base portion for being fixed on the insulative housing, a connecting portion upwardly extending from the base portion, an elastic portion forwardly and rearwardly extending from an extremely end of the connecting portion, a locking portion disposed on a front side of the elastic portion and exposed to the insulative housing, and a pressing portion downwardly extending from a rear end of the elastic portion beyond the base portion; the outer case defines an operating portion for operating the latching member; the operating portion drives the pressing portion to disengage the latching with a mating connector; and the operating direction of the operating portion is opposite to the movement direction of the locking portion.

DETAILED DESCRIPTION OF THE PREFERRED EMBODIMENT

Figure 1:
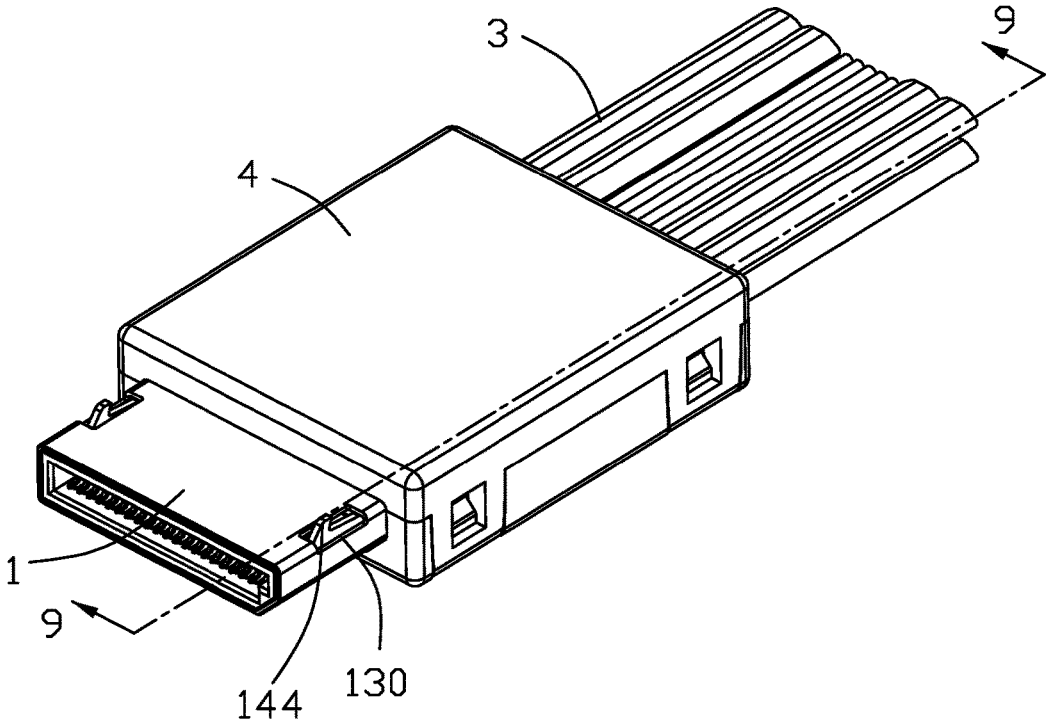
FIG. 1 is a perspective view of a plug connector assembly in accordance with the present invention.
Figure 2:
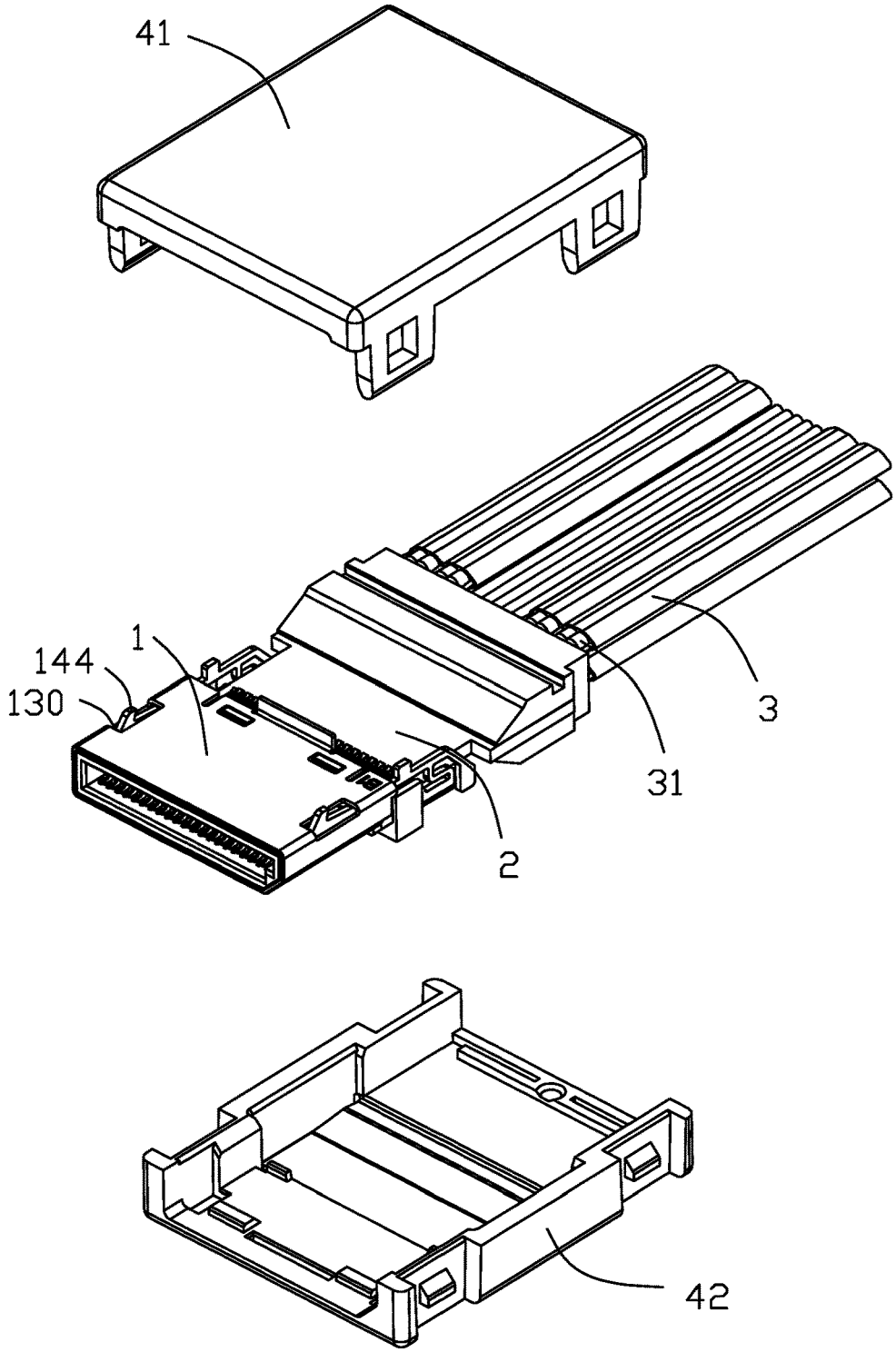
FIG. 2 is a partly exploded view of the plug connector assembly in FIG. 1.
Figure 3:
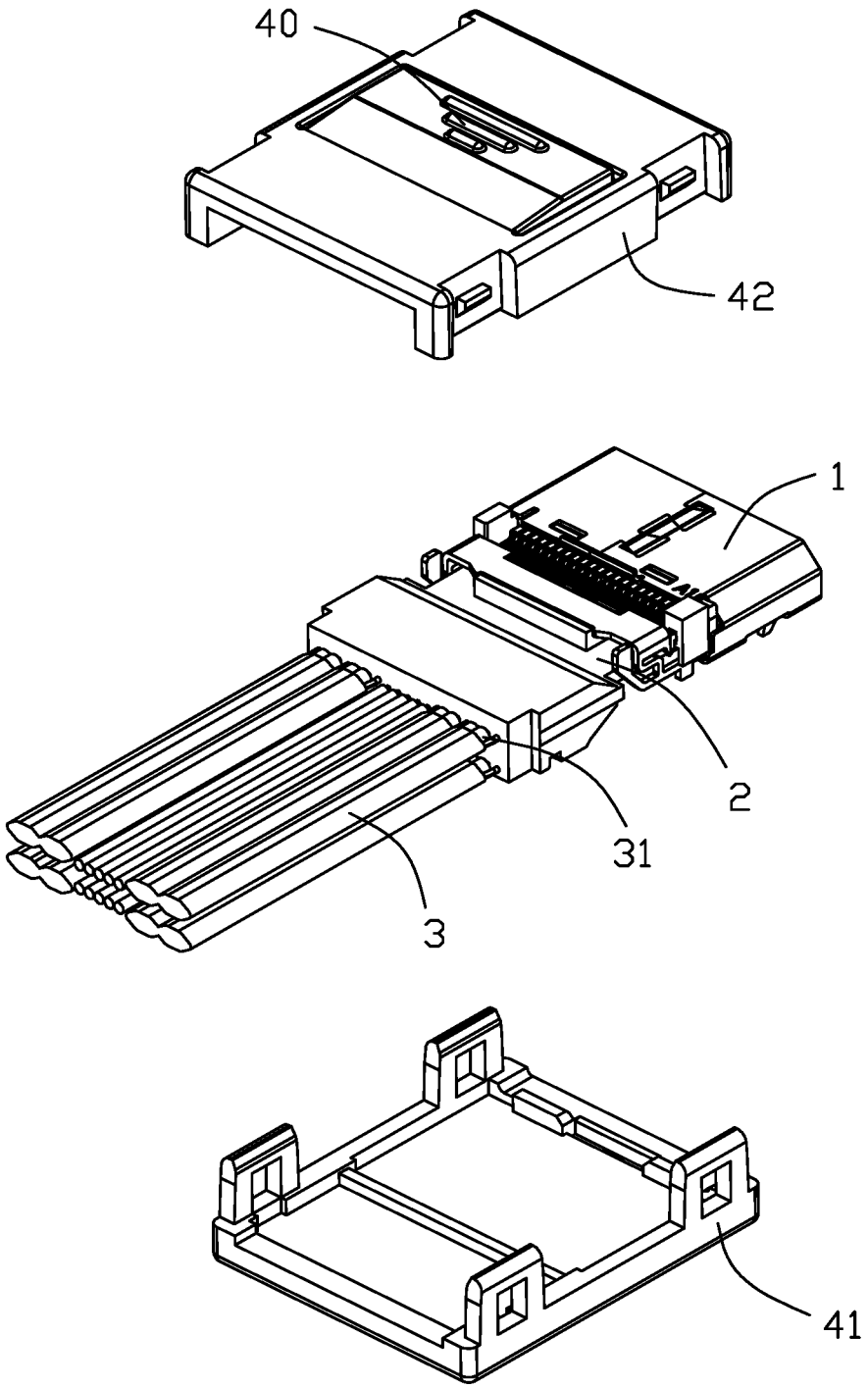
FIG. 3 is a partly exploded view similar to FIG. 2, but from a different aspect.
Figure 4:
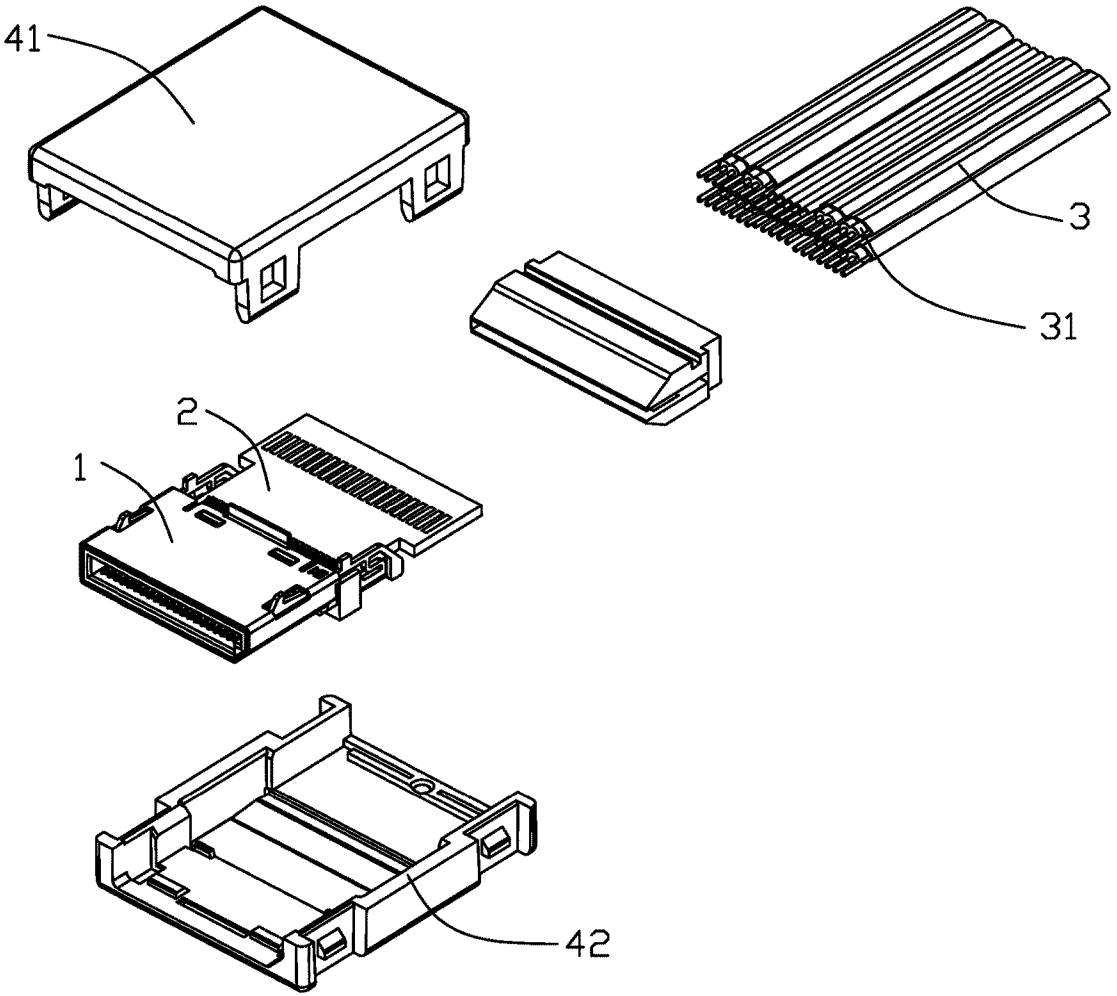
FIG. 4 is a further partly exploded view of the plug connector assembly in FIG. 2.
Figure 5:
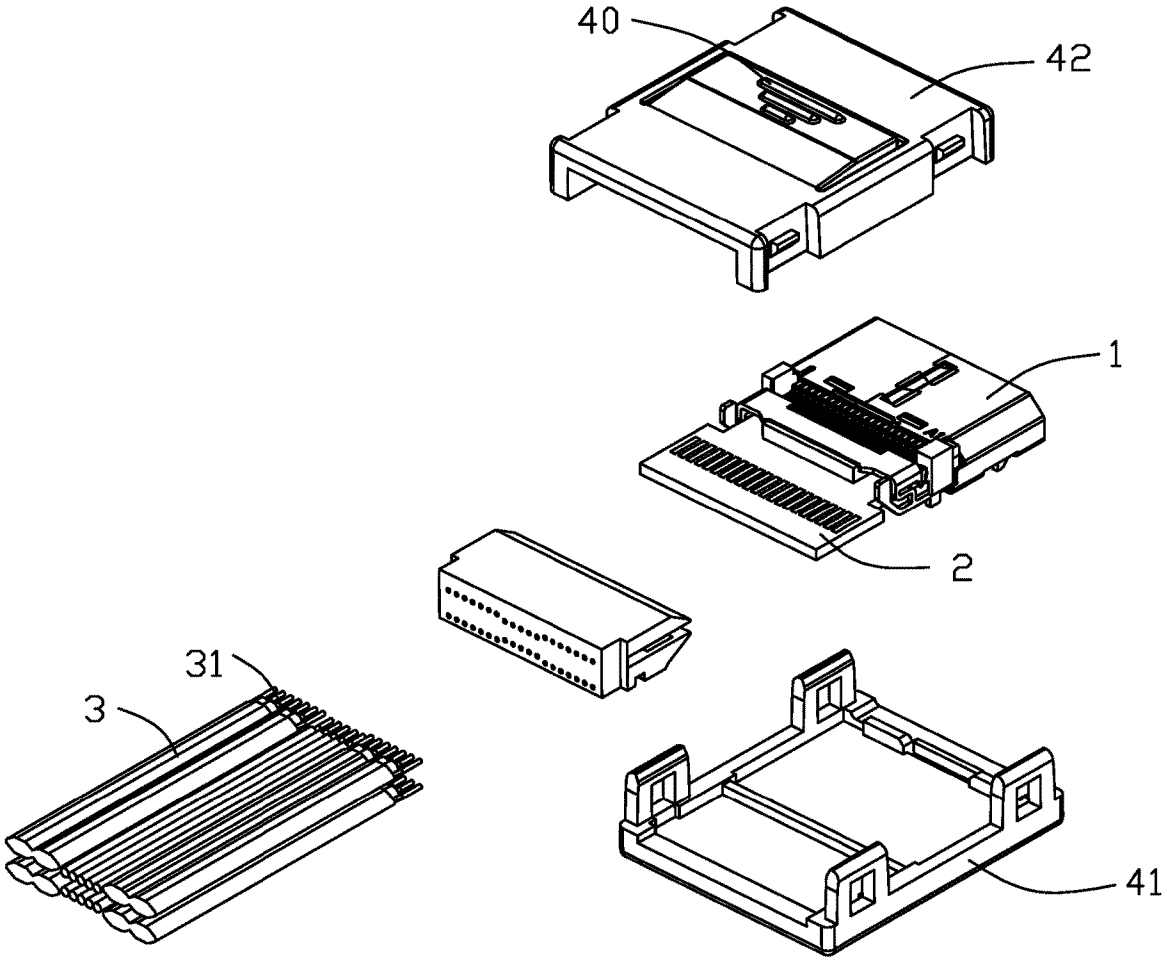
FIG. 5 is a further partly exploded view of the plug connector assembly in FIG. 4, but from a different aspect.
Figure 6:
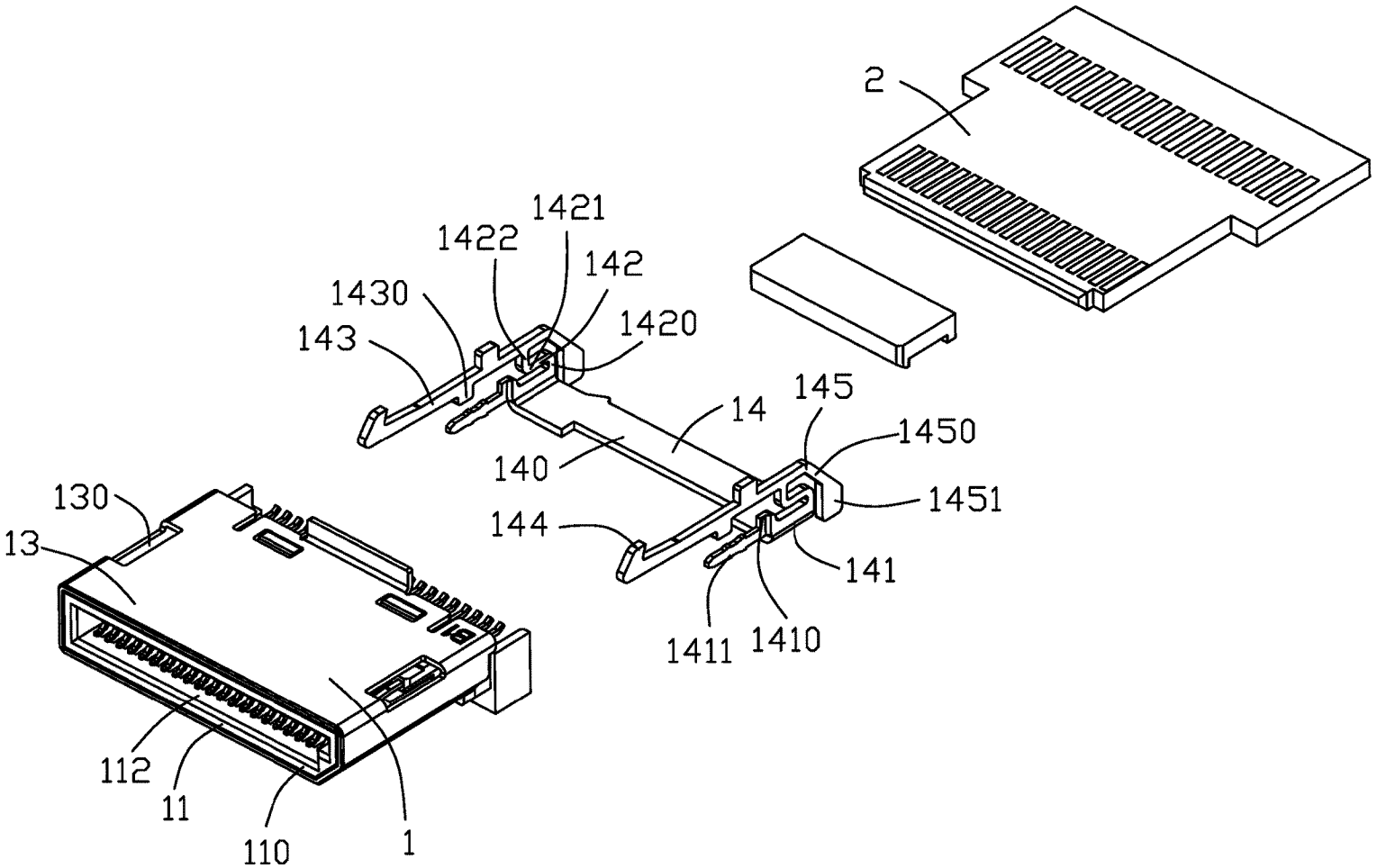
FIG. 6 is a further partly exploded view of the plug connector assembly in FIG. 4, but removing the cable and the outer case.
Figure 7:
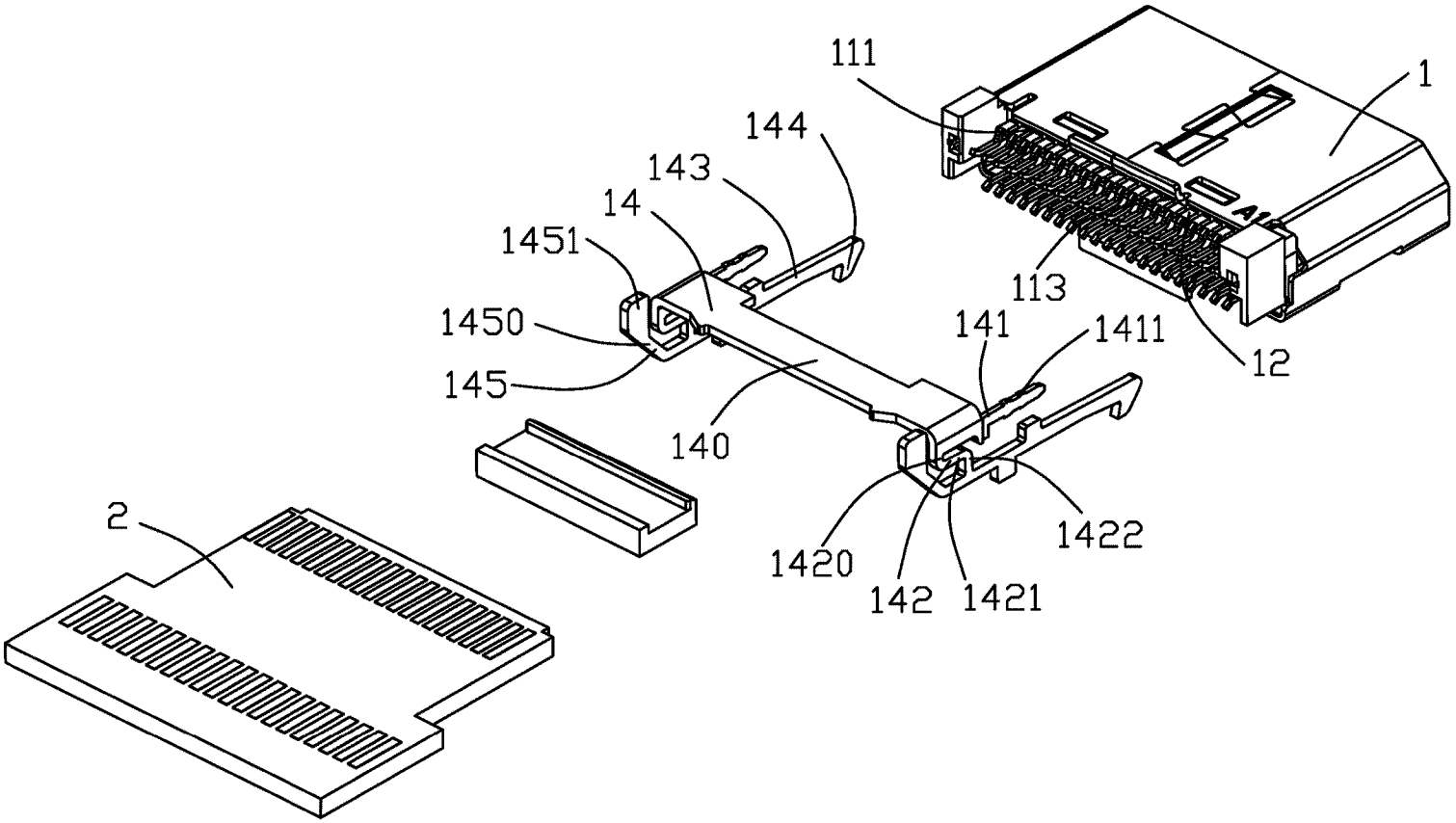
FIG. 7 is a further partly exploded view similar to FIG. 6, but from a different aspect.
Figure 8:
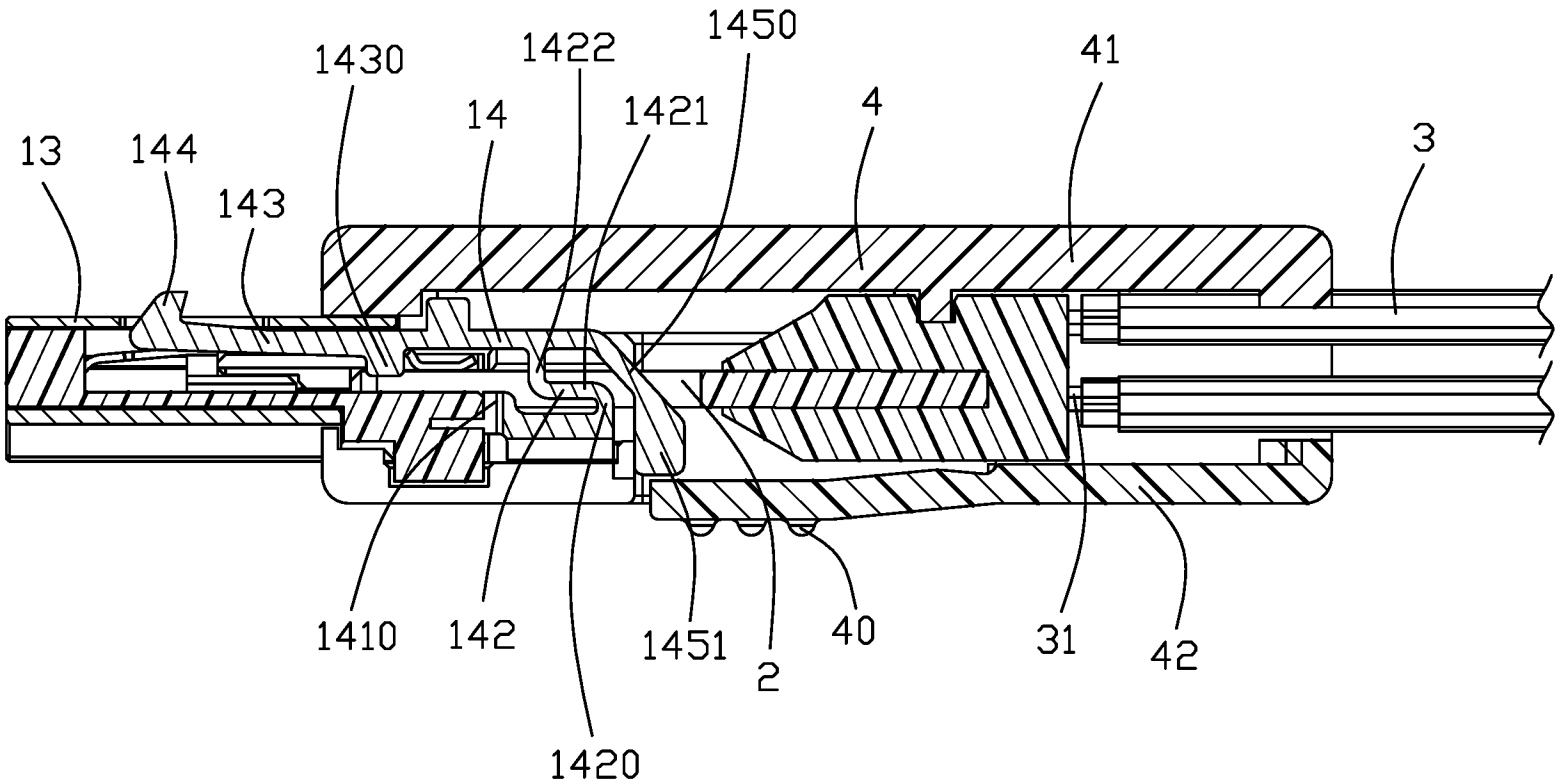
FIG. 8 is a cross-sectional view taken along line 9-9 in FIG. 1.

Referring to FIGS. 1 to 8, a plug connector assembly 100 in accordance with the present invention for latching with a mating connector (not shown), comprises a mating member 1, a printed circuit board 2 electrically connected to the mating member 1, a cable 3 electrically connected with the printed circuit board 2, and an outer case 4 enclosing the mating member 1 and cable 3. The printed circuit board 4 is connected to the mating member 1 on an end thereof and connected to the cable 3 on another end thereof. The cable 3 is a flat structure and includes a plurality of core wires 31.

The mating member 1 includes an insulative housing 11, a contacting module 12 retained in the insulative housing 11, a metal case 13 enclosing the insulative housing 11, and a latching member 14 assembled on the mating member 1 for latching with the mating connector.

The insulative housing 11 defines a mating surface 111 disposed on a front end thereof, an opposite mounting surface 111, a mating slot 112 inwardly extending from the mating surface 111, and a mounting slot 113 inwardly extending from the mounting surface 111 and communicating with the mating slot 112.

The metal case 13 surrounds the insulative housing 11, exposing the mating surface 110 and the mounting surface 111 to outside thereof. The metal case 13 defines a pair of through holes 130 on a side thereof.

The latching member 14 includes a base portion 140, a pair of fixing portions 141 spaced and forwardly extending from the base portion 140, a pair of connecting portions 142 spaced and upwardly extending from the base portion 140, a pair of elastic portions 143 forwardly and rearwardly extending from an extremely end of the corresponding connecting portion 142 respectively, a pair of locking portions 144 disposed on a front end of the corresponding elastic portion 143 and exposed to the insulative housing 11, and a pair of pressing portions 145 downwardly extending from a rear end of the corresponding elastic portion 143 and beyond the base portion 140.

The fixing portion 141 is fixed on the insulative housing 11. Each of the fixing portions 141 defines a stopping portion 1410 extending upwardly there from, to prevent the corresponding fixing portions 141 from being inserted into the insulative housing 11 excessively. Each of the fixing portions 141 defines a plurality of barbs 1411 to reinforce the holding of the corresponding fixing portions 141 with the insulating body.

Both of the connecting portions 142 are angled structures with plural sections to increase deformability thereof, more specifically, each of the connecting portions 142 includes a first vertical portion 1420 upwardly extending from the base portion 140, a horizontal portion 1421 forwardly extending from the vertical portion 1420, and a second vertical portion 1422 upwardly extending from the horizontal portion 1421 to connect with the elastic portion 143.

Each of the elastic portions 143 defines a limiting portion 1430 disposed on a front side of the corresponding connecting portion 142 and downwardly extending from the corresponding elastic portion 143, for preventing the corresponding elastic portion 143 from being excessively pressed. The pair of locking portions 144 is passed through the corresponding through holes 130 to be exposed to the outer side of the metal case 13, for locking with the mating connector.

Each of pressing portion 145 includes an extending portion 1450 rearwardly and obliquely downwardly extending from a rear end of the corresponding connecting portion 142, and a pressure portion 1451 downwardly extending from an extremely end of the extending portion 1450. The width of the pressure portion 1451 is greater than the width of the extending portion 1450.

The outer case 4 includes a first case 41 and a second case 42 engaging with the first case 41 by snap-in way. The outer case 4 defines an operating portion 40 on an opposite side relative to the locking portion 144 of the latching member 14, for operating the latching member 14. Operators press the operating portion 40 to apply a force to the pressure portion 1451, and then further drive the locking portion 144 to move toward the inside of the insulative housing 11, finally disengage the latching with the mating connector. The operating direction of the operating portion 40 is opposite to the moving direction of the locking portion 144.

Compared to the prior art, the operating portions 40 and the locking portions 144 of the plug connector assembly 100 of the present invention are disposed on opposite sides, thus, the locking portions 144 have a large movement space, and it is easy to release the latching of the mating connector.

What is claimed is:

1. A plug connector assembly comprising:

a mating member including an insulative housing and a latching member retained in the insulative housing;

a cable electrically connected to the mating member; and an outer case enclosing the mating member and the cable; wherein the latching member includes a base portion, a fixing portion forwardly extending from the base portion for being fixed on the insulative housing, a connecting portion upwardly extending from the base portion, an elastic portion forwardly and rearwardly extending from the connecting portion, a locking portion disposed on a front side of the elastic portion and exposed through the insulative housing, and a pressing portion downwardly extending from a rear end of the elastic portion beyond the base portion;

the outer case defines an operating portion for operating the latching member;

the operating portion being operable to drive the pressing portion to disengage the latching member from a mating connector;

the operating direction of the operating portion is opposite to the movement direction of the locking portion;

the connecting portion is a bent structure; and the connecting portion includes a first vertical portion upwardly extending from the base portion, a horizontal portion forwardly extending from the first vertical portion, and a second vertical portion upwardly extending from the horizontal portion to connect to the elastic portion.

2. The plug connector assembly as claimed in claim 1, wherein the fixing portion defines a stopping portion for preventing the fixing portion from being excessively inserted into the insulative housing.

3. The plug connector assembly as claimed in claim 1, wherein the elastic portion defines a downwardly extending limiting portion disposed on a front side of the connecting portion for preventing the elastic portion from being pressed excessively.

4. The plug connector assembly as claimed in claim 1, wherein the pressing portion includes an extending portion rearwardly and obliquely downwardly extending from a rear end of the connecting portion, and a pressure portion continually to extend downwardly from a distal end of the extending portion, and the operating portion of the outer case applies a force to the pressure portion.

5. The plug connector assembly as claimed in claim 4, wherein a width of the pressure portion is greater than a width of the extending portion.

6. The plug connector assembly as claimed in claim 1, wherein the latching member includes a pair of fixing portions.

7. The plug connector assembly as claimed in claim 6, wherein the latching member includes a pair of spaced connecting portions, a pair of elastic portions connecting with the corresponding connecting portions, a pair of locking portions disposed on a front side of the corresponding elastic portion, and a pair of pressing portions extending from a rear end of the corresponding elastic portion.

8. The plug connector assembly as claimed in claim 7, wherein the mating member includes a metal case enclosing the insulative housing, the metal case including a pair of through holes for exposing the corresponding locking portions to outside.

9. A plug connector assembly comprising:

a mating member including an insulative housing and a latching member retained in the insulative housing;

a cable electrically connected to the mating member; and an outer case enclosing the mating member and the cable; wherein the latching member includes a base portion, a fixing portion forwardly extending from the base portion for being fixed on the insulative housing, a connecting portion upwardly extending from the base portion, an elastic portion forwardly and rearwardly extending from the connecting portion, a locking portion disposed on a front side of the elastic portion and exposed through the insulative housing, and a pressing portion downwardly extending from a rear end of the elastic portion beyond the base portion;

the outer case defines an operating portion for operating the latching member;

the operating portion being operable to drive the pressing portion to disengage the latching member from a mating connector;

the operating direction of the operating portion is opposite to the movement direction of the locking portion; and the pressing portion includes an extending portion rearwardly and obliquely downwardly extending from a rear end of the connecting portion, and a pressure portion continually to extend downwardly from a distal end of the extending portion, and the operating portion of the outer case applies a force to the pressure portion.

10. The plug connector assembly as claimed in claim 9, wherein the fixing portion defines a stopping portion for preventing the fixing portion from being excessively inserted into the insulative housing.

11. The plug connector assembly as claimed in claim 9, wherein the connecting portion is a bent structure.

12. The plug connector assembly as claimed in claim 9, wherein the elastic portion defines a downwardly extending limiting portion disposed on a front side of the connecting portion for preventing the elastic portion from being pressed excessively.

13. The plug connector assembly as claimed in claim 9, wherein a width of the pressure portion is greater than a width of the extending portion.

14. The plug connector assembly as claimed in claim 9, wherein the latching member includes a pair of fixing portions.

15. The plug connector assembly as claimed in claim 14, wherein the latching member includes a pair of spaced connecting portions, a pair of elastic portions connecting with the corresponding connecting portions, a pair of locking portions disposed on a front side of the corresponding elastic portion, and a pair of pressing portions extending from a rear end of the corresponding elastic portion.

16. The plug connector assembly as claimed in claim 15, wherein the mating member includes a metal case enclosing the insulative housing, the metal case including a pair of through holes for exposing the corresponding locking portions to outside.

17. A plug connector assembly comprising:

a mating member including an insulative housing and a latching member retained in the insulative housing;

a cable electrically connected to the mating member; and an outer case enclosing the mating member and the cable;

the latching member including a transversely extending base portion, a pair of fixing portions extending respectively from two opposite ends of the base portion and fixed to the insulative housing, a pair of connecting portions extending respectively from said two opposite ends of the base portion, a pair of elastic portions extending respectively from the pair of connecting portions, a pair of locking portions respectively formed on corresponding front ends of the pair of elastic portions, and a pair of pressing portions respectively extending from corresponding rear ends of the pair of elastic portions wherein the pair of pressing portions and the pair of locking portions are essentially located by two sides of the pair of connecting portions when viewed transversely;

a vertically moveable operating portion disposed around the pair of pressing portions; and the operating portion being operable to drive the pair of pressing portions to further disengage the pair of locking portions from a mating connector; wherein the operating portion and the pair of pressing portions are associatively operated to move along a first vertical direction, and the locking portions are actuated, in response to movements of said pair of pressing portions, to move along a second vertical direction opposite to the first vertical direction; wherein said locking portions outwardly protrude and are outwardly exposed to an exterior along the same first vertical direction while the operating portion is outwardly exposed to the exterior along the second vertical direction.

18. The plug connector assembly as claimed in claim 17, wherein said operating portion is formed on said outer case.

19. The plug connector assembly as claimed in claim 17, wherein the locking portions are located on an upper side of the mating member while the operating portion is located on an underside of the outer case.

20. The plug connector assembly as claimed in claim 17, wherein each of said connecting portions includes plural sections to increase deformability thereof.

* * * * *